United States Patent [19]

Bührmann et al.

[11] Patent Number: 4,465,514

[45] Date of Patent: Aug. 14, 1984

[54] METHOD OF PRODUCING STEEL BY THE LD PROCESS

[75] Inventors: Gerardus P. Bührmann, Velsen-Zuid; Adam Steen, Heemskerk, both of Netherlands

[73] Assignee: Hoogovens Groep B.V., Netherlands

[21] Appl. No.: 495,719

[22] Filed: May 18, 1983

Related U.S. Application Data

[62] Division of Ser. No. 440,401, Nov. 9, 1982.

[30] Foreign Application Priority Data

Nov. 18, 1981 [NL] Netherlands ..... 8105221

[51] Int. Cl.[3] ..... C21C 5/32

[52] U.S. Cl. ..... 75/60

[58] Field of Search ..... 75/60

[56] References Cited

U.S. PATENT DOCUMENTS

| | | | |
|---|---|---|---|
| 3,252,790 | 5/1966 | Krivsky | 75/60 |
| 4,168,158 | 9/1979 | Iwaoka et al. | 75/60 |
| 4,210,442 | 6/1980 | Lewis et al. | 75/60 |

*Primary Examiner*—L. Dewayne Rutledge
*Assistant Examiner*—Robert L. McDowell
*Attorney, Agent, or Firm*—Stevens, Davis, Miller & Mosher

[57] ABSTRACT

A method of producing steel by the LD process using a metallurgical vessel by blowing gas through an oxygen lance onto the top of the molten metal bath in the vessel for a period of time and during the final portion of the period blowing nitrogen directly into the metal bath through a gas-transmitting wall element. The duration of the final portion is from 0 to 2 minutes. The rate of gas supply through the wall element during the final portion is 5 to 8 $Nm^3/h$ per ton of metal in the vessel.

3 Claims, 4 Drawing Figures

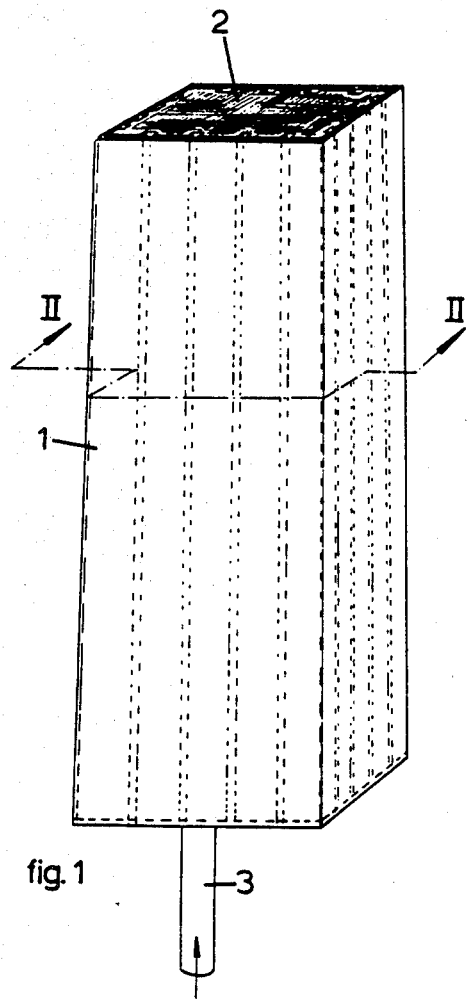
fig. 1
fig. 3
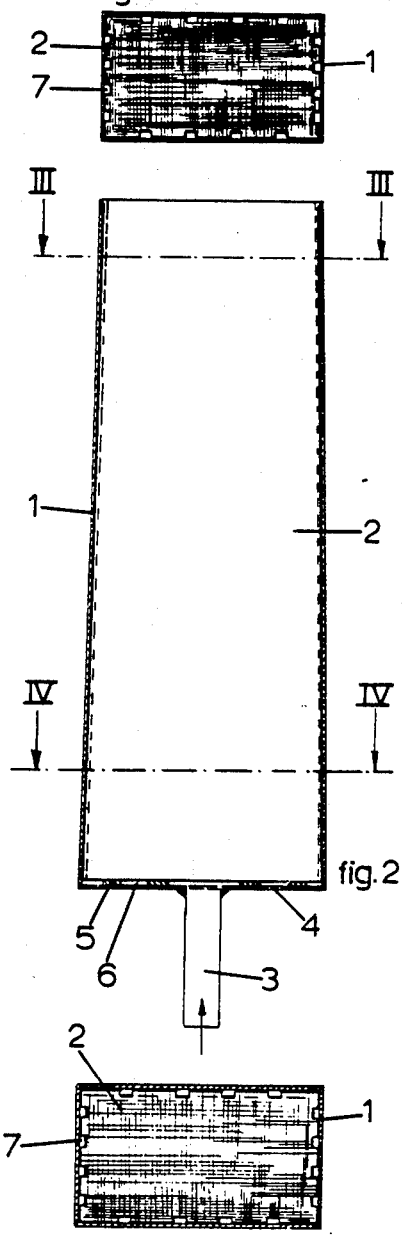
fig. 2
fig. 4

METHOD OF PRODUCING STEEL BY THE LD PROCESS

This is a division of application Ser. No. 440,401 filed Nov. 9, 1982, pending.

BACKGROUND OF THE INVENTION

1. Field of the Invention

The invention relates to a gas-transmitting wall element for a metallurgical vessel lined with refractory material. In this specification and in the context of the invention, the term metallurgical vessel includes a converter for steel-making as well as steel ladles and treatment vessels for non-ferrous metals. The gas-transmitting wall element is suitable for fitting either into the bottom wall or into the side wall of the vessel. The invention also relates to a metallurgical vessel including such a wall element, and to a method of steel making by the "LD-process".

The invention will be described here in particular with reference to the application of the gas-transmitting wall element in a steel converter, but the invention is expressly not restricted to this application.

2. Description of the Prior Art

When making steel in a steel converter, a tilting vessel is often used, in which oxygen is blown at the top of the vessel onto the molten iron in the vessel. This may or may not be accompanied by the charging of scrap and/or slag-forming additives.

At present there is a great deal of interest in processes in which gas is also blown in at the bottom. To do this, for example, a very porous bottom brick is used to inject non-oxidising gases such as argon, nitrogen or CO. The purpose of this is to produce extra mixing in the metal bath, and by means of this scavenging gas to remove unwanted elements from the bath.

Processes have also been proposed in which blast pipes or blast pipes with a ring gap are used. In this case, within a flow of non-oxidixing buffer gas, other gases such as oxygen, $CO_2$, argon, nitrogen or air can be blown in. There are also proposals completely to replace the oxygen supply from above by oxygen which is blown in from below through the bottom.

One drawback of the known structures with inlet pipes, whether or not these are combined with a ring gap, is the need to blow in a substantial quantity of gas during the whole time that a bath is present in the vessel. This is to prevent fluid from the bath leaking into the pipes and/or ring gap. In addition it has been found that these pipes can be susceptible to very rapid wear at the rate of a few mm per charge. Also, when using pipes, solidification of the steel may occur because of excessive local cooling at the pipe or close to it; this can prevent the required continuous flow of the gaseous element.

High cost is a drawback of the use of porous bricks. This is a result of the complicated way in which these bricks are produced, in that during moulding of the brick a large number of pores or channels of a very small diameter have to be produced which have to remain intact while the brick is being fired. It has been found that the reproducibility of the porosity is poor and also that the range over which the porosity can be varied is small.

DE-A-No. 2719829 discloses a gas-transmitting wall element having a refractory brick whose side and base walls are narrowly spaced from a metal housing. Near the base there are grooves in the brick. It is difficult to maintain this narrow spacing in practice, because of the pressures on the wall element and the problem of locating the brick accurately in the housing.

SUMMARY OF THE INVENTION

The object of the invention is therefore to provide a gas-transmitting element which may be produced cheaply, which is subject to little wear and which can be manufactured with good reproducibility while it should be possible considerably to vary the porosity in the manufacturing process. Furthermore the element should render continuous blowing of gas through the contents of the vessel unnecessary.

Briefly, the invention consists in a wall element comprising a metal box, open at the one end, with a gas inlet pipe discharging into the closed end, the box containing spaced from the closed end, at least one refractory element engaging the box wall and having on its side surfaces grooves for the passage of the gas to the open end of the box.

It has been found simple to mould such a refractory element with grooves on its side walls, and by altering the shape and number of grooves, the porosity of the wall element can be selected over a wide range, while the reproducibility of this process is high.

Where the refractory lining of the metallurgical vessel consists of bricks, as is usual in a steel converter, the wall element of the element is highly suitable since the metal box can be of the same shape as one or more of the lining bricks at the region where the wall element is fitted. When the wall lining is being built gas-transmitting wall element can simply be incorporated into the normal wall pattern.

Even if the need for gas transmission through the wall element is greater than can be obtained with a single refractory brick in the wall element, according to the invention it is possible to have a plurality of refractory bricks next to one another inside the metal box. This increases the number of grooves accordingly, and hence the gas flow.

When the metallurgical vessel is heated up, thermal expansion produces an internal pressure in the brickwork, which constantly presses the metal box wall against the refractory brick. Even a slight initial pressure in a gas being passed through the supply line to the wall element ensures that the grooves remain fully open, and prevents them being blocked. Conversely the dimensions of the grooves can be kept so small that no molten metal can penetrate in the reverse direction to the flow of gas. Even if the initial pressure in the gas is removed, the molten metal will only be able to penetrate the grooves to a very slight degree and then solidify without causing the grooves to be blocked.

Although it is feasible to make the refractory brick in the metal box from a fired brick, this does not seem to be necessary, and a cheaper structure of the same quality can be obtained if the refractory brick is formed as an unfired, pressure-moulded brick made of refractory grains and a binder. For example the refractory brick can be formed from particles of calcined magnesite and a tar binder. This is the material that is often used to make masonry bricks of a converter. When the converter is in operation this tar-bonded brick is gradually calcined, releasing tar vapours and adhering the grains together.

The grooves can be produced in the brick by suitably shaping the pressure mould. However, it has been found much simpler to pressure-mould a brick with smooth walls and then to make grooves by sawing. These grooves are preferably rectangular in shape, e.g. about 5 mm wide and 3 mm deep. Suitably the grooves are produced at spacings of from 10 to 40 mm. It should be noted that, depending on the requirements of particular use of the element, much narrower and shallower, or wider and deeper, grooves can be produced.

Preferably the refractory element is held at a distance from the closed end of the metal box by one or more spacers. The aim is to ensure that the feed gas can distribute evenly under the refractory brick or bricks to the different grooves. The spacers may form part of the refractory brick, which will then cost more to mould. The end of the box can alternatively have projections on it. A very simple and cheap arrangement has been found to be that of placing spacers as loose elements between the closed end and the refractory brick. These may for example be loose rods, or meshwork or coarse gauze.

The main purpose of the metal box is to provide sufficient support for the refractory filling, to ensure that the grooves remain intact. There may be no other special requirements of the metal box, and good results can be achieved with a box produced from steel sheet which is preferably at least one mm thick.

We will now discuss the method aspect of the invention, and the preferred embodiment thereof.

By intensively blowing gas through the wall element during the main oxygen lance blowing period in the LD-steel making process in the converter, a considerable cooling effect is produced, with a corresponding reduction in the calorific efficiency of the process. This has been verified in a 100 ton converter by monitoring the optimum scrap input when operating respectively with and without blowing through the wall element. Without blowing, under conventional operating conditions, 260 kg of scrap can be fed in for each ton of steel tapped. On the other hand, if a stream of gas of 600 $Nm^3/h$ is blown continuously through the wall element as mentioned above, only 240 kg of scrap per ton of steel can be used.

For this reason, it is preferable not to blow through the wall element during the main blowing period, or only to a slight degree. This is better done while the decarburizing reaction, which may cause ejection of expensive steel from the converter may occur, is well underway. By blowing gas in through the bottom of the converter, the decarburizing reaction is subdued, without the oxygen feed through the lance having to be reduced.

The most significant effect of blowing through the wall element can be obtained at the end of the oxygen blowing period, when the formation of slag in the converter is well in progress, which is during the last 2 minutes of the oxygen blowing. By blowing intensively (up to 5 to 8 $Nm^3/h$ per ton of converter capacity) through the bottom during at least part of this time, with all other conditions being equal, there are considerable metallurgical advantages as shown from the following table I. This compares the values for the measured contents of Mn, P and S in the steel after tapping from the converter, and the loss in iron to the slag, respectively with and without gas being blown through the converter bottom.

TABLE 1

| | with bottom blowing | without bottom blowing |
|---|---|---|
| $[Mn]_{tap}$ | 0.250% | 0.190% |
| $[P]_{tap}$ | 0.010% | 0.012% |
| $[S]_{tap}$ | 0.015% | 0.017% |
| $(Fe)_{slag}$ | 13% | 17% |

These results clearly show that a 4% saving of iron is achieved, in conjunction with a considerable saving in the expensive alloying element Mn. Additionally, the amounts present of the unwanted elements S and P are further reduced.

If nitrogen is blown through the bottom, some unwanted absorption of nitrogen into the steel will occur. Blowing argon avoids this disadvantage but results in higher cost because of the higher price of argon. It has been found that a good compromise is to blow first with nitrogen, then gradually replace the nitrogen with argon or another inert gas. The nitrogen content in the steel can thus be controlled in a simple way, as shown by the following table II.

TABLE II

| Fraction of blowing time after which $N_2$ is replaced by argon | Increase $[N]_{tap}$ by blowing through wall element |
|---|---|
| 0.5 | — |
| 0.75 | 5 ppm |
| 0.90 | 12 ppm |

It is therefore preferable to blow a non-nitrogen containing gas through the wall element during the last 9 to 60 seconds of the blowing period of the main oxygen lance.

BRIEF DESCRIPTION OF THE DRAWINGS

The preferred embodiment of the wall element of the invention will now be described by way of non-limitative example with reference to the accompanying drawings, in which:

FIG. 1 shows the preferred wall element embodying the invention schematically in perspective.

FIG. 2 is a longitudinal section on the line II—II in FIG. 1.

FIG. 3 is a transverse section on the line III—III in FIG. 2.

FIG. 4 is a transverse section near the bottom on the line IV—IV in FIG. 2.

The gas-transmitting wall element shown in the drawings has a slightly tapering thin-walled metal box 1 open at its top end. This box is roughly the shape of a lining brick in the bottom of a steel converter. In the particular embodiment described, this box is 550 mm high, although another height may be chosen for a converter with masonry bricks of a different size. Within the side walls of the box 1 is a refractory filling in the form of a refractory element 2, which is a brick produced by pressure moulding a mixture of tar binder with a mass of calcined magnesite. Such pressure moulded elements are used commonly in the steel industry, and do not require any further explanation.

The wall element is arranged to be connected to a gas supply via an inlet pipe 3, for a gas which is to be fed into the bottom of the converter. The pipe 3 discharges through the bottom wall 4 of box 1. Loose spacer plates 5, also made of refractory material, are placed between the bottom 4 and refractory element 2, to keep passages open between the discharge from feed pipe 3 and the side walls of the box 1. The free space 6 between the bottom wall 4 and the refractory element 2 is about 8 mm high in the case shown.

The element 2 contacts the side walls of the box 1 and in the side walls of element 2, rectangular longitudinal grooves 7 are sawn, as indicated in FIGS. 3 and 4. These grooves are about 3 mm deep and about 5 mm wide and, with the side walls of the box, form passages extending from the lower end of the brick 2 to the upper end thereof, where the gas is introduced into the converter.

It has been found that it is possible with the wall element illustrated, using an initial gas pressure of 5 atmospheres, to produce a gas flow of between 250 and 800 $Nm_3/h$ during operation of a steel converter. It has also been found that the wear of this wall element is negligible. In practice it has been found that an average of only 1½mm wear per charge occurs and that the gas-transmitting element of the dimensions shown can be used for about 260 charges before replacement is necessary or before the element needs to be sealed from above with a ductile refractory mass.

Because of its design, it has been found that during calcining of the tar-bonded brick, the tar vapours formed can simply escape. A slight flow of gas through the grooves will prevent blockage by condensation of tar vapours on the colder spots.

Though the invention is here illustrated by preferred embodiments only, it is not restricted to such embodiments but extends to all equivalents thereof and to all embodiments within the spirit of the invention and the scope of the claims.

What is claimed is:

1. A method of producing steel by the LD process, using a metallurgical vessel comprising blowing gas onto the top of a molten metal bath in the vessel for a period of time through an oxygen lance, and during the final portion of said period of blowing of the main oxygen lance, blowing nitrogen gas for a part of the final portion of said period directly into the metal bath through a gas-transmitting wall element so as to reduce the violence of the decarburization reaction in the metal bath, the duration of said final portion being in the range 0 to 2 minutes, and the rate of gas supply through the said wall element during said final portion being in the range 5 to 8 $Nm^3/h$ per ton of metal in the vessel.

2. A method according to claim 1 wherein during a period which is the last 9 to 60 seconds of the blowing period of the main oxygen lance, the gas supplied through said wall element is a non-nitrogen containing gas.

3. A method according to claim 2 wherein the gas is argon.

* * * * *